United States Patent [19]

Cook

[11] Patent Number: 4,659,081

[45] Date of Patent: Apr. 21, 1987

[54] GOLF PRACTICE APPARATUS

[75] Inventor: James L. Cook, Kirkcaldy, United Kingdom

[73] Assignee: Cooxint Limited, Great Britain

[21] Appl. No.: 668,726

[22] PCT Filed: Feb. 29, 1984

[86] PCT No.: PCT/GB84/00065

§ 371 Date: Oct. 29, 1984

§ 102(e) Date: Oct. 29, 1984

[87] PCT Pub. No.: WO84/03448

PCT Pub. Date: Sep. 13, 1984

[30] Foreign Application Priority Data

Mar. 2, 1983 [GB] United Kingdom ..... 8305734

[51] Int. Cl.[4] ..... A63B 57/00

[52] U.S. Cl. ..... 273/201

[58] Field of Search ..... 273/201, 26 R, 29 BB, 273/410

[56] References Cited

U.S. PATENT DOCUMENTS

| | | | |
|---|---|---|---|
| 1,998,454 | 4/1935 | Gordon | 273/29 BB |
| 3,567,223 | 3/1971 | Gentiluomo | 273/201 |
| 4,126,313 | 11/1978 | Izumi | 273/201 |

*Primary Examiner*—Leo P. Picard
*Assistant Examiner*—T. Brown
*Attorney, Agent, or Firm*—Gerald J. Ferguson, Jr.; Michael P. Hoffman; Ronni S. Malamud

[57] ABSTRACT

The apparatus is comprised of a platform from which a player may drive a ball into an enclosure. A sloping floor is provided to return balls to a reservoir placed under the platform. A teeing mechanism operated by a player presents balls one at a time to a tee. The mechanism is comprised of a pneumatic system with master and servo bellows.

10 Claims, 6 Drawing Figures

GOLF PRACTICE APPARATUS

This invention relates to apparatus for practising golf.

There have been many prior proposals relating to such apparatus, but few if any have come into practical use. It has been proposed hitherto to make use of a reservoir of balls which are presented one at a time to the player by means of a teeing mechanism. Examples of such arrangements are to be seen, for example, in the following patents:

U.S. Pat. No. 3, 378, 263
U.S. Pat. No. 3, 298, 694
U.S. Pat. No. 3, 533, 631
U.S. Pat. No. 2, 711, 321

Such mechanisms have practical disadvantages. Many are unduly complex and expensive, are not readily transportable, and require connection to mains power. Others are simpler but would be difficult or inconvenient to operate.

An object of this invention is to provide a golf practice apparatus which is relatively cheap to manufacture and simple to use, which can be used both indoors and outdoors, and which requires no external power supply.

According to one aspect of the invention there is provided apparatus for the practice of golf, comprising a platform, a tee movable through an opening in the platform between an upper position projecting above the platform and a lower position below the platform, a chamber for a supply of golf balls, means for freeing one ball at a time to be delivered to and squarely positioned on the tee when in said lower position, a pneumatic servo unit mounting the tee, a master pneumatic unit connected to the servo unit by a conduit and movable by a user to produce a pressure difference causing movement of the servo unit.

From another aspect the invention provides apparatus for the practice of golf, comprising a platform, a ball reservoir beneath the platform, a teeing mechanism operable to present balls from the reservoir one at a time on a tee movable through an aperture in the platform, an enclosure extending from one side of the platform into which balls may be driven, the enclosure having a floor sloped to cause balls driven into the enclosure to return under gravity to the reservoir.

Figure 1:
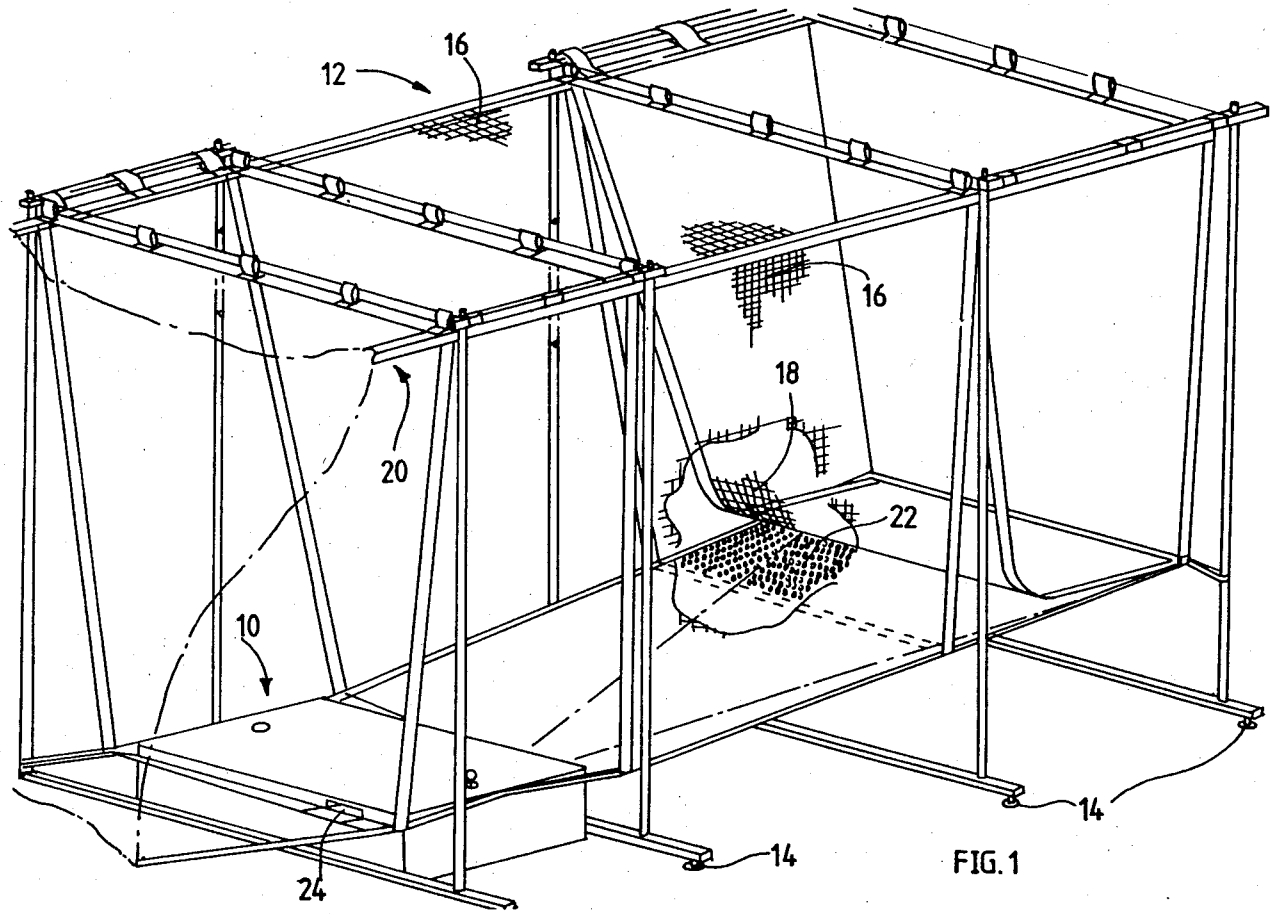
Figure 2:
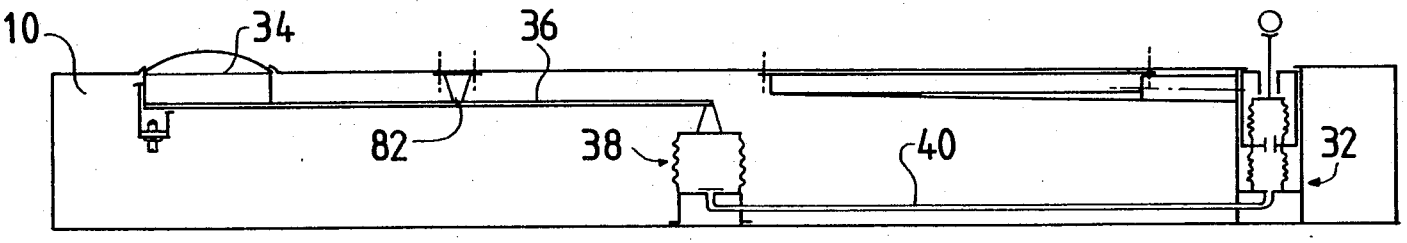
Figure 3:
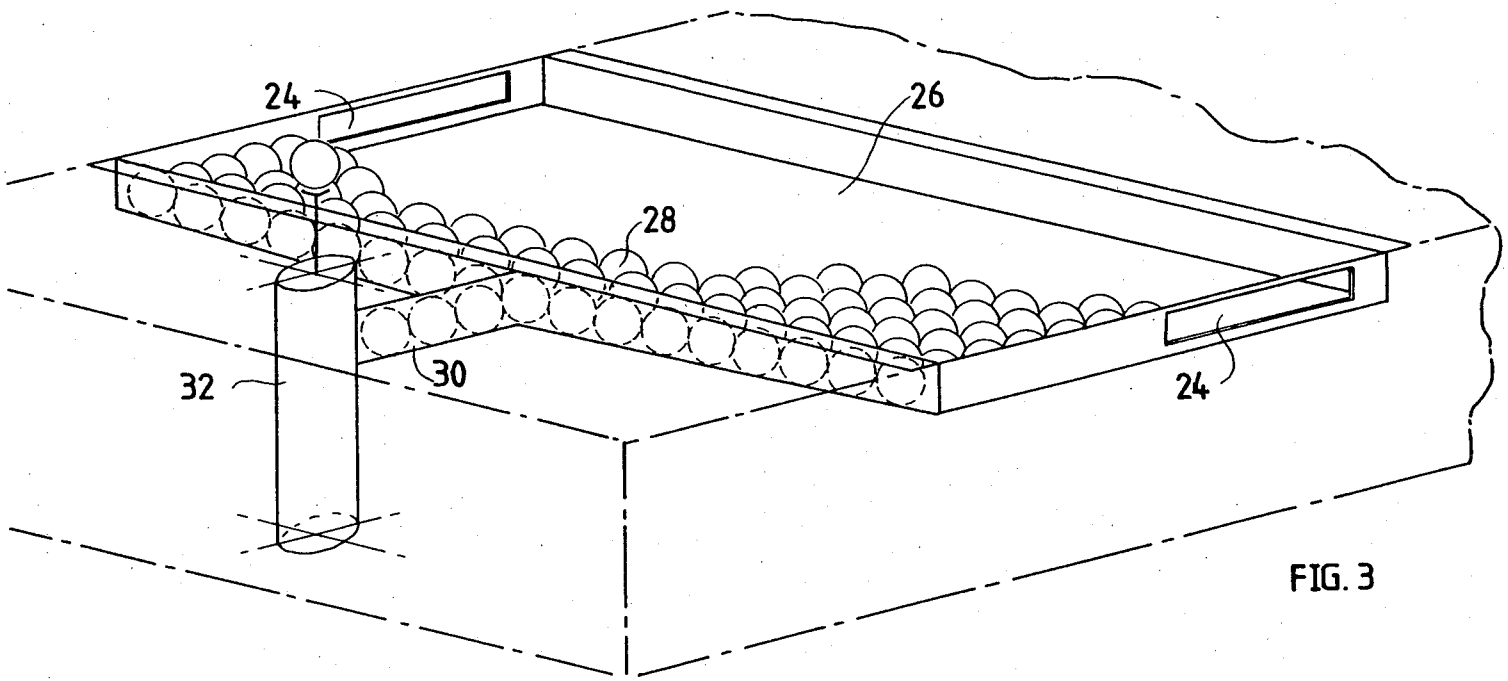
Figure 4:
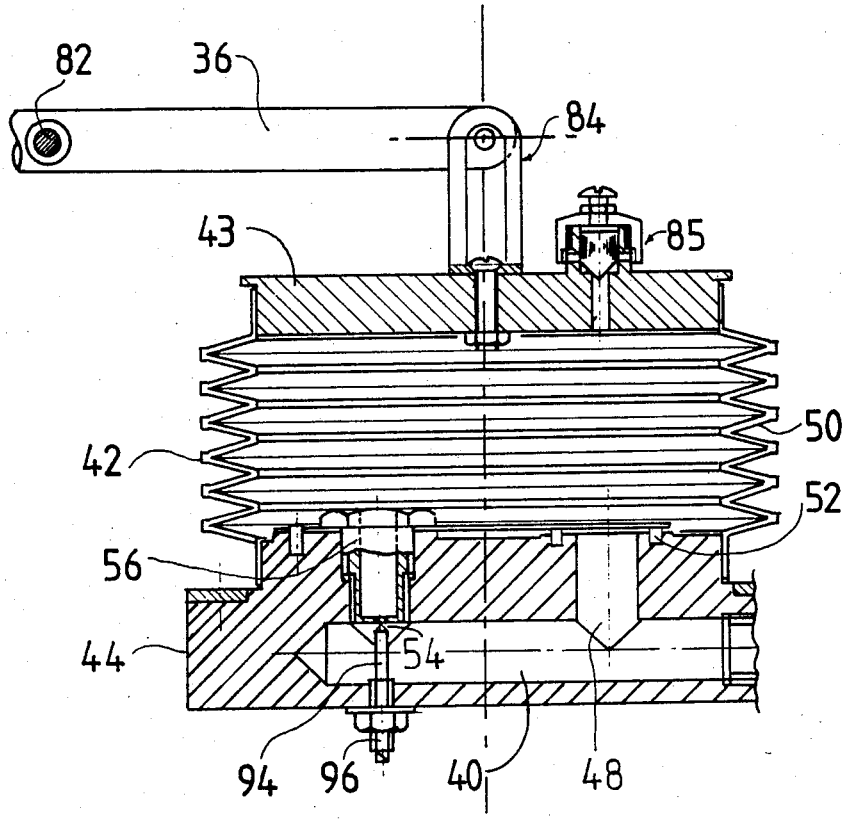
Figure 5:
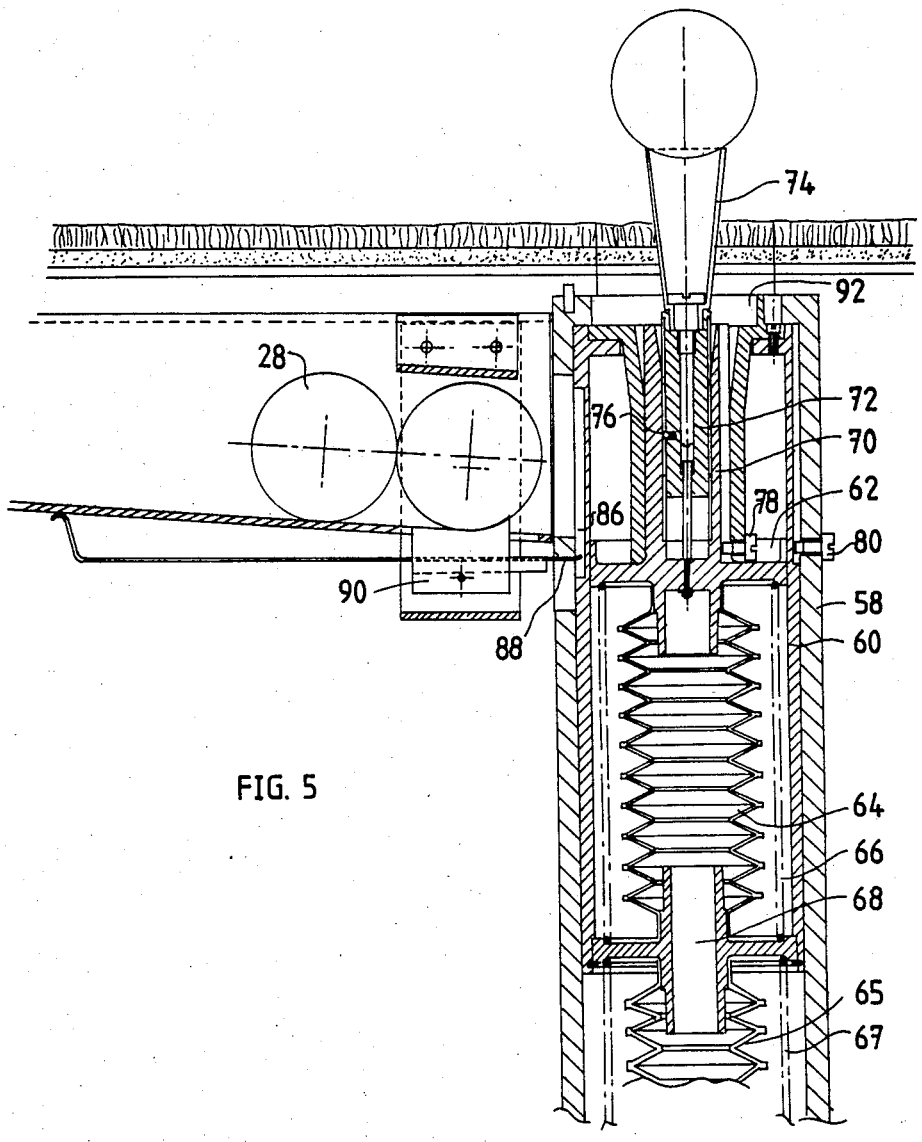
Figure 6:
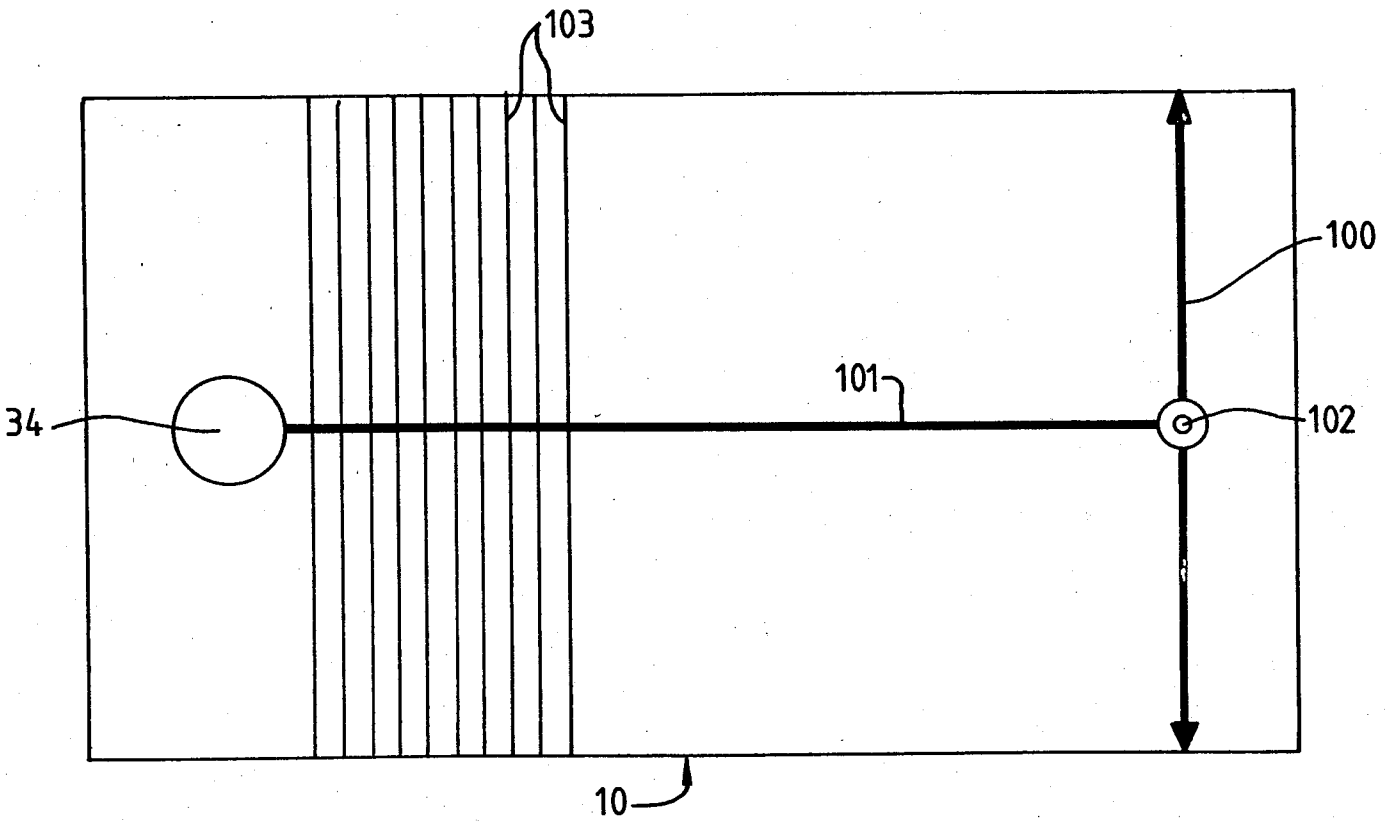

An embodiment of the invention will now be described, by way of example, with reference to the drawings, in which:

FIG. 1 is a general isometric view of an apparatus according to the invention, FIG. 2 is a schematic side cross-sectional view of the platform of FIG. 1, FIG. 3 is a schematic isometric view of the ball reservoir of FIG. 1, FIG. 4 is a detailed cross-section of the master unit seen in FIG. 2, FIG. 5 is a detailed cross-section of the servo unit seen in FIG. 2, and FIG. 6 is a plan view of the platform surface in a modified embodiment.

Referring to FIG. 1, the apparatus has a platform assembly generally designated 10, and a framework generally designated 12 mounted on ground-engaging feet 14. The framework 12 is of such dimensions that it can be erected by a person standing on the ground. Netting indicated at 16 is secured (by any suitable means) inside the top and sides of the framework 12 to form an enclosure into which balls may be driven by a player standing on the platform 10. The parts of the netting 16 are suitably joined together by rot-resistant fabric tape. A further net is draped as shown within the enclosure to form an impact curtain 18 which decelerates the balls in a safe manner. The impact curtain 18 is suitably arranged to slope downwardly away from the player and should have sufficient fullness and flexibility to decelerate the balls without any risk of rebound. The floor 22 of the enclosure is suitably formed of rot-resistant fabric or tensioned net, or of stiffer, self-supporting mesh plastics material (to provide drainage) and is sloped both towards the longitudinal centre line and towards the platform 10.

A similar enclosure may be provided on the opposite side of the platform 10, as indicated in outline at 20.

With reference to FIGS. 1, 2 and 3, each ball after deceleration by the impact curtain 18 falls to the floor 22 to roll by gravity to pass via an opening 24 into a reservoir 26 in the platform 10. The reservoir 26 has a sloping floor to channel balls 28 therein to a tube 30 from which the balls are elevated one at a time by a teeing mechanism 32 under the control of the player.

Referring specificially to FIG. 2, a pedal 34 protrudes through the platform 10 for operation by the player. The pedal 34 is connected by a pivoted lever 36 to actuate a pneumatic master unit 38 which is connected via a conduit 40 to a pneumatic servo unit in the teeing mechanism, as will be described in detail below. The arrangement is such that the player may depress and immediately release the pedal 34, and this action will cause a fresh ball to be teed up.

The aperture for the pedal 34 is 108 mm in diameter, the present size of a putting green hole under the Rules of Golf. The pedal 34 has a cap which may be removed to provide access for adjusting the mechanism to be described and to permit the platform to be used for putting practice, for which purpose it may suitably be surfaced with artificial turf. A suitable artificial turf may also be used to allow practice with "iron" clubs.

The unoccupied space under the platform may be arranged to store the netting and framework when the apparatus is not in use.

Turning to FIGS. 4 and 5, the master unit as shown in FIG. 4 comprises a bellows 42 clamped between an upper end plate 43 and lower end plate 44. The interior of the bellows 42 communicates with the conduit 40 via a one-way valve formed by bore 48, flexible tongue 50 and seat 52, and also via an orifice 54 formed in a screw threaded insert 56 which also serves to secure the tongue 50. The master unit is connected to the lever 36 via a pin-and-slot lost motion linkage 84. The master unit is provided with one or more pressure balance valve 85 which opens at a predetermined pressure to relieve shock loads, and also allows for changes in ambient pressure.

The servo unit, as shown in FIG. 5, comprises a cylindrical casing 58 in which slides a hollow cylinder 60. A piston 62 is slidable within the cylinder 60. A first bellows 64 is mounted between the cylinder 60 and the piston 62, as also is a spring 66 which is dimensioned to just support the weight of the piston 62 and the parts carried thereby. A second bellows 65 and spring 67 are connected between the cylinder 60 and the casing 58. The two bellows 64,65 are in communication via port 68, and the second bellows 65 communicates with the conduit 40.

The piston 62 carries a boss 70 in which is screw-threaded a plug 72 mounting a conical tee 74 of resilient plastics material. The plug 72 may be rotated to adjust the height of the tee; a spring-urged ball 76 engages with a vertical groove in the boss 70 to give a "click" on each turn and to prevent inadvertent adjustment of the tee. Set screws 78,80 engage grooves in the boss 70 and cylinder 60 respectively to prevent these rotating during axial movement and when the tee is being rotatably adjusted.

When the player requires a golf ball to be elevated on the tee he simply presses the foot pedal 34 fully down thereby causing the lever 36 to rotate about pivot 82 and consequently the upper end plate 43 of the master unit will be raised thus expanding master bellows 42. The master bellows 42, the conduit 40, and servo bellows 64,65 are all filled with a fluid, preferably, but not essentially, a gas which is initially at atmospheric pressure in the "normal" position when the tee is fully elevated. Thus, expansion of the master bellows 42 will create a depression thereby causing the flexible tongue 50 to lift from its seat 52 on end plate 44 and allow greater access to the conduit 40 leading to the servo bellows 64. Expansion of the master bellows 42 will also reduce the pressure of the gas in the servo bellows 64,65 below atmospheric pressure and thereby reduce the pressure thrust offered by the gas in the system. Atmospheric pressure outside the system will remain constant and therefrom a net gauge pressure thrust will act down on the servo unit thus causing piston 62 and cylinder 60 to descend against the resistance of the bellows 64,65 and springs 66,67.

Near the bottom of its stroke the upper end of slot 86 of the cylinder 60 will come in contact with spring lever 88 and during the remainder of its descent will cause trigger 90 to rotate clockwise (FIG. 5), thus releasing the first golf ball into outer casing 58 and holding back the remainder of the golf balls. The first golf ball will roll by gravity into the casing 58 and rest on top of cylinder 60 and the tee 74 which has been pulled inside the cylinder 60 by the pressure thrust acting on the bellows 64. All that is required to make this occur is sufficient pressure drop in the system of bellows 42, 64 and 65 which is governed by the displacement volume given to the master bellows 42 by the movement of the foot pedal 34.

During descent, it is less important to have the piston 62 move in any special way related to the casing, although damping will occur due to the pressure thrust acting on the end plate 43 of the master unit, but on the return stroke when both units are ascending it is imperative that the golf ball, which is about to be raised, is (a) positioned squarely on the tee before ascension commences and (b) remains on the tee during and at the end of the ascent. To ensure that (a) occurs, the piston 62 which carries the tee 74 is made to move relative to the cylinder 58, such that at the bottom of the down stroke (the loading position) the top of the tee 74 is below the top coned surface of the cylinder 60 thereby ensuring that the golf ball assumes a central position on the tee before being raised. An arcuate lip 92 on the top of the cylinder is aligned in this condition above and around the upper surface of the tee, and helps to guide the ball onto the tee.

To ensure that (b) occurs, there must be deceleration of the piston 62 and the tee 74 relative to the outer casing 58 ending in zero velocity when the golf ball is fully elevated. Therefore some form of control over the time to elevate the golf ball must be introduced. This is provided by the insert 56 in the base of the master unit having an orifice or a nozzle 54 in its centre. The cross-sectional area of the orifice or nozzle will be a function of the time to elevate, and if, for example, the fluid is a gas and in particular air then it may be considered that subsonic flow only is required and if a nozzle is chosen for the design then only the convergent part of such a nozzle would be required. In either case (i.e. using an orifice or a nozzle) the rate of air flow will be a function of the pressure ratio across the orifice plate, from the entry, to the throat or vena-contracta. Consequently the velocity of the piston, tee or golf ball at any given time will also depend on the pressure ratio existing across the orifice and when this pressure ratio is equal to unity then the rate of flow will be zero and hence the velocity of the piston, tee and golf ball will be zero. Thus by ensuring that the pressure ratio across the orifice varies from some value below unity (but above the value required for supersonic flow) to a value equal to unity, it is assured that both subsonic flow will occur and, more important, deceleration to zero velocity will exist during the ascension of the primary unit, tee and golf ball thus eliminating a sudden deceleration at the end of the ascent and therefore minimising the possibility of the golf ball falling off the tee. The cross-sectional area of the orifice or nozzle 54 in the orifice insert 56 is therefore critical to the function of the automatic loader for successfully teeing-up golf balls. The flow area may be adjusted by means of a needle 94 carried on a screw-threaded adjuster 96 (FIG. 4).

An estimate of the throat area "Ath" is given by the following general equation, neglecting pipe losses and losses due to the contraction and enlargement;

$$Ath = \left(\frac{1}{cd \cdot t}\right)\left\{\left[A \cdot \tanh^{-1}\left(M_1 \frac{\gamma - 1}{2}\right)\right] + B \cdot M_1\right\}^{1}$$

where

Ath = throat area of the orifice or nozzle cd = coefficient of discharge for the orifice or nozzle t = required time to raise the primary unit, and golf ball $M_1$ = initial Mach number $\gamma$ = index of the thermodynamic process A = a constant B = another constant It may be seen from this equation that the throat area is inversely proportional to the required time and conversely the time is inversely proportional to the throat area. Therefore, if the throat area of the orifice or nozzle, or any passage from the master unit to the servo unit (e.g. the conduit 40) is large enough, then the time for fluid to pass from one to the other may be considered instantaneous. Such is the case when the servo units are descending and the flexible tongue is lifted from its seat to allow free access of the fluid from the primary and secondary unit to the master unit during expansion thereof. The time for the expansion process should be minimised and hence it may be considered instantaneous and negligible.

Returning now to the situation when the operator has pressed the foot pedal 34 and sufficient expansion of the master bellows 42 has taken place to reduce the pressure inside the system of three bellows to below atmospheric pressure such that the pressure thrust due to atmospheric pressure is greater than the pressure thrust due to absolute pressure inside the system. The net gauge pressure thrust acting down on the servo unit must be sufficient to overcome the resistance offered by the springs 66,67 and the bellows 64,65 to ensure that both the cylinder and the piston reach their lower stops and operate the trigger 90 to release the first golf ball. The net pressure thrust must also overcome the minimal resistance offered by the spring lever 88. In addition to the trigger 90 releasing one ball at a time, it also serves to maintain a constant frictional resistance between the cylinder 60 and the outer casing 58 by preventing the total remaining load of golf balls in the tube 30 and the reservoir 28 from applying a component force lateral to the wall of the cylinder 60 during the ascent or descent of the cylinder 60. omitting the trigger 90 would result in a varying frictional resistance and consequently a considerable variation in the time to elevate a golf ball, if the apparatus were designed to operate under the greatest frictional resistance when the reservoir 28 was considered full. If, with such a design, the enclosure were not used by an operator to return each golf ball to the reservoir 28 then the component lateral force produced by the load of golf balls would diminish as the reservoir 28 emptied with each successive practice shot and consequently for a given design of apparatus, with a constant spring rate and bellows rate of resistance, the time to elevate a golf ball would reduce to an unacceptable level whereby the ball may topple from the tee. Therefore the trigger 90 is important to the present invention.

On releasing the foot pedal 42, there will be a sudden increase in pressure inside the master bellows 42 only, due to the flexible tongue 50 returning to its seat 52 and due to the restriction imposed by the orifice or nozzle 54. A pressure difference will exist across the orifice or nozzle 54 and the gas (in this case air), momentarily trapped in the master bellows 42, will flow through the orifice or nozzle 54 at a rate corresponding to the pressure ratio across the orifice. As the flow continues the pressure downstream of the orifice (i.e. in the conduit 40 and bellows 64,65) will increase with time and hence the pressure ratio will increase with time. According to theory, the mass flow rate through an orifice or nozzle depends only on the pressure ratio across the orifice or nozzle such that, as the pressure ratio increases, the mass flow rate decreases. Hence, in this aspect of the present invention, the mass flow rate will decrease with time during the ascent of the cylinder and piston and consequently the rate of increase of pressure in the servo bellows will decrease with time thus producing deceleration of the servo to zero velocity when the pressure ratio reaches the value of unity, that is, when the pressure in the servo bellows is equal to the pressure in the master bellows at atmospheric. Thus the servo unit will ascend, initially with acceleration on release of the foot pedal 42 from zero velocity to some maximum velocity depending on the lowest pressure ratio experienced across the orifice and thereafter with deceleration from this maximum velocity to zero velocity in the normal position when both cylinder and piston are against their upper stops.

It may now be recognised that there are many designs which would satisfy the present invention. The designer may choose to arbitrarily select a total time for a golf ball to elevate from the "loading" position to the "normal" position and then estimate the throat are of the orifice or nozzle 54 from equation 1 by substituting the constants A & B for known values already established in the design. Should this prove to be unsatisfactory then some experimentation may be carried out with various other throat areas or adjustment to the existing orifice until an acceptable performance of the automatic means for teeing-up golf balls is found.

The system of bellows and the conduit are preferably hermetically sealed, and as such it is envisaged that there will be less problems with friction and possible leaks of the fluid than would otherwise arise from the alternative of using pistons and seals in preference to flexible enclosed bellows. When the apparatus is not being used, the "normal" position will be assumed and it may be observed that the apparatus will be in its most relaxed condition with the springs, bellows and net pressure thrust at their least value thereby offering a greater cyclic life to the apparatus.

The modification shown in FIG. 6 provides means to assist an operator to practice the undertaking of a proper grip, a proper stance and accepted general posture, relative to a golf ball (elevated on a tee) and the intended direction of flight. This preparation is made easier to repeat, and hence encourages consistency by habit, in the present invention by the introduction of markings on the top surface of the platform. Suggested markings are shown in FIG. 6 and are considered to be basic requirements only. The markings 100 and 101, set at 90° to each other, are essential to remind the player of his proper stance and general posture relative to a golf ball 102 and intended direction of flight 100. The supplementary markings 103 remind the player of the distance his feet should be from the golf ball corresponding to the golf club to be used. The markings 103 are all parallel to each other and parallel to the markings 100. Combining the aid offered by all the markings 100, 101 and 103, the correct stance and general posture is more consistently assured for any player whether male or female, tall or short, young or old, right-handed or left-handed. Thus the markings 100, 101 and 103 provide a datum in two directions about which a player may practice the correct and proper address of a golf ball with any regulation golf club chosen for the purpose of striking a golf ball with consistent accuracy in the direction of intended flight along the line provided by the markings 100 having arrow heads pointing in opposite directions to suit both right-handed and left-handed players. The markings 100, 101 and 103 may be applied in any suitable manner for example by means of paint or by applying a tape or ribbon material secured by an adhesive.

I claim:

1. Apparatus for the practice of golf, comprising a platform, a tee movable through an opening in the platform between an upper position projecting above the platform and a lower position below the platform, a chamber for a supply of golf balls, means for freeing one ball at a time to be delivered to and squarely positioned on the tee when in said lower position, a pneumatic servo unit mounting the tee, a master pneumatic unit connected to the servo unit by a conduit and moveable by a user to produce a pressure difference causing movement of the servo unit, the pneumatic system comprising the master unit, the servo unit and the conduit including a valve which allows free flow of air in one direction and restricted flow via a calibrated orifice in the other direction, movement of the tee to its upper position being controlled by air flow through the calibrated orifice such that the tee decelerates smoothly to its upper position.

2. The apparatus of claim 1, in which the servo unit comprises first and second bellows, the second bellows carrying the first bellows within a cylinder and the first bellows carrying the tee such that, when the tee is in its lower position, the ball-receiving surface of the tee is positioned at or below the top of the cylinder.

3. The apparatus of claim 1, in which the master unit and servo unit are actuated by a foot pedal projecting through the platform.

4. The apparatus of claim 3, in which the pedal has a cap projecting through a circular opening, the cap being removable to permit the opening to be used as a putting practice hole, having a diameter in accordance with the rules of golf.

5. The apparatus of claim 1, in which the means for freeing one ball at a time comprises a trigger adapted to release the first golf ball and simultaneously hold back the remaining golf balls.

6. The apparatus of claim 1, in which the tee height may be rotatably adjusted.

7. The apparatus of claim 1, in which the means for returning said golf balls to the chamber comprises an enclosure extending from the platform into which the user may drive a ball, the enclosure having a floor portion shaped to cause golf balls to roll into a receptacle below the platform for recirculation to said chamber.

8. The apparatus of claim 7, in which the enclosure is formed by a net.

9. The apparatus of claim 7 or claim 8, in which a ball-decelerating member is provided within the enclosure in the form of a sheet of flexible material suspended from the roof of the enclosure and arranged to slope away from the user towards its foot.

10. Apparatus according to claim 1, in which the platform is provided with a plurality of markings for facilitating the user in adopting the proper stance and general position when addressing the golf ball.

* * * * *